US006213820B1

(12) United States Patent
Kanno

(10) Patent No.: US 6,213,820 B1
(45) Date of Patent: Apr. 10, 2001

(54) CONTROL FOR WATERCRAFT ENGINE

(75) Inventor: Isao Kanno, Iwata (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/512,189

(22) Filed: Feb. 22, 2000

(30) Foreign Application Priority Data

Feb. 23, 1999 (JP) ..... 11-044465

(51) Int. Cl.[7] ..... B63H 21/22
(52) U.S. Cl. ..... 440/1; 440/2; 440/87
(58) Field of Search ..... 440/1, 84, 88, 440/2

(56) References Cited

U.S. PATENT DOCUMENTS 3,893,108 * 7/1975 McBride, Jr. et al. ..... 340/507
4,019,489 * 4/1977 Cartmill ..... 123/198 D
5,704,819 1/1998 Isogawa .
5,778,848 7/1998 Takahashi .
5,876,188 3/1999 Okamoto .
5,997,371 * 12/1999 Oishi ..... 440/77
6,086,435 * 7/2000 Hoshiba et al. ..... 440/1

* cited by examiner

*Primary Examiner*—S. Joseph Morano
*Assistant Examiner*—Andrew Wright
(74) *Attorney, Agent, or Firm*—Knobbe, Martens, Olson & Bear, LLP

(57) ABSTRACT

A watercraft engine includes a lubrication system alarm control system which initiates an alarm when lubricant pressure within the lubrication system falls below an acceptable pressure. The alarm system compares lubricant pressure during engine operation with a lower pressure threshold which is determined as a function of engine speed. Thus, partial reductions in lubricant pressure are identified. Additionally, the alarm control system may be configured to emit an alarm if lubricant pressure fluctuates at a rate that is greater than a predetermined pressure fluctuation rate threshold.

33 Claims, 8 Drawing Sheets

CONTROL FOR WATERCRAFT ENGINE

PRIORITY INFORMATION

This application is based on and claims priority to Japanese Patent Application No. 11-44465 filed Feb. 23, 1999, the entire contents of which is hereby expressly corporated by reference.

BACKGROUND OF THE INVENTION

1. Field of the Invention

The present invention generally relates to alarm control systems for engines. More specifically, the present invention relates to alarm control systems for lubrication systems of engines of outboard motors.

2. Description of Related Art

Outboard motors pose unique challenges to engine designers due to their orientation and the rotation of the engines about a tilting and trimming axis during operation. One such challenge involves supplying lubricant to the moving components of the engine during a variety of operating conditions. Because the orientation of the engine changes during use, accurately sensing a level of lubricant remaining in an lubricant pan becomes difficult, if not impossible. Accurate monitoring of the lubricant is desirable to ensure that the engine is not run dry of lubricant because of a leak or a clogged passage.

In some outboard motors, the engine has a pressure sensor that detects a decrease in lubricant by evaluating the operating pressure within the lubrication system. If the pressure falls to a level indicative of a malfunction, then a buzzer or other alarm immediately sounds. One difficulty in such sensors is determining whether the low pressure is indicative of an actual problem or, rather, is indicative of a sudden change in operating conditions. For instance, due to the viscous nature of oil as a lubricant, the pressure of the lubricant does not vary as rapidly as engine speed. Accordingly, upon rapid acceleration, the lubricant pressure may incorrectly indicate a low pressure and a nonexistent malfunction.

Some engine designers have remedied these false alarm problems by setting the sensor to indicate a problem only when the pressure falls below a minimum pressure that corresponds to an adequate supply of lubricant during idle speed operation.

SUMMARY OF THE INVENTION

One aspect of the present invention includes the realization that when a lubrication alarm system of an outboard motor is configured trigger an alarm only when the oil pressure falls below a predetermined minimum oil pressure for idle speed operation, the engine may operate at higher speeds with inadequate lubrication, thereby reducing the durability and life span of the engine. For example, although an outboard motor may generate sufficient minimum oil pressure at idle so as to prevent a conventional oil pressure alarm system from being triggered, the engine may operate at higher speeds with an inadequate flow rate of oil. This condition may be produced by a number of various causes such as, for example but without limitation, a leak, or a partial or complete blockage of one of the lubricant galleries within the engine. Although the engine may generate sufficient oil pressure at idle, a leak or a blockage within the engine may cause the oil pressure to fall below the appropriate pressure for the corresponding engine speed above idle. Thus, conventional systems do not adequately address the problems associated with lubricant pressure irregularities at engine speeds above idle.

A need therefore exists for a lubrication system for an outboard motor which is able to better identify inadequate lubricant pressure at engine speeds above idle and emit appropriate alarms when the lubricant pressure falls below a desired pressure.

In accordance with one aspect of the present invention, a lubricant pressure alarm system for use in a marine engine, includes an engine speed sensor, a lubricant pressure sensor, and an alarm threshold calculator configured to calculate a threshold pressure based on the engine speed. The alarm system is configured to emit an alarm signal when a lubricant pressure within the engine falls below the alarm threshold. By providing a lubrication alarm system as such, the present invention ensures that an operator is adequately informed of inadequate lubrication flows during high speed operation.

According to another aspect of the invention, the lubrication alarm system is configured so as to emit an alarm if the lubricant pressure within the engine fluctuates above a predetermined fluctuation rate during operation. Thus, by configuring the lubrication alarm system as such, the lubrication system informs an operator of a potential malfunction of the lubrication system. For example, if a vehicle is operated in a rough manner, liquid lubricant in an lubricant pan of the engine may be violently sloshed within the lubricant pan. Such movement of the liquid lubricant may cause the pressure to fluctuate rapidly as the lubricant inlet in the lubricant pan becomes exposed and resubmerged in the liquid lubricant, allowing air to enter the lubricant inlet and the lubricant pump. As the inlet repeatedly becomes exposed above the level of liquid and resubmerged below the liquid lubricant, the pressure in the lubricant system fluctuates due to the air entering the system. Thus, by configuration the lubricant alarm system to emit an alarm when the pressure in the lubricant system fluctuates above a predetermined rate, the operator of the associated vehicle is informed of the interruption in lubricant delivery, and thus may stop the engine or slow the engine speed so as to prevent damage to the engine.

Further aspects, features and advantages of this invention will become apparent from the detailed description of the preferred embodiments which follow.

BRIEF DESCRIPTION OF THE DRAWINGS

The above-mentioned and other features of the invention will now be described with reference to the drawings of preferred embodiments of the present lubricant alarm system. The illustrated embodiment of the lubricant alarm system is intended to illustrate, but not to limit the invention. The drawings contain the following figures.

DETAILED DESCRIPTION OF THE PREFERRED EMBODIMENT OF THE INVENTION

Figure 1:
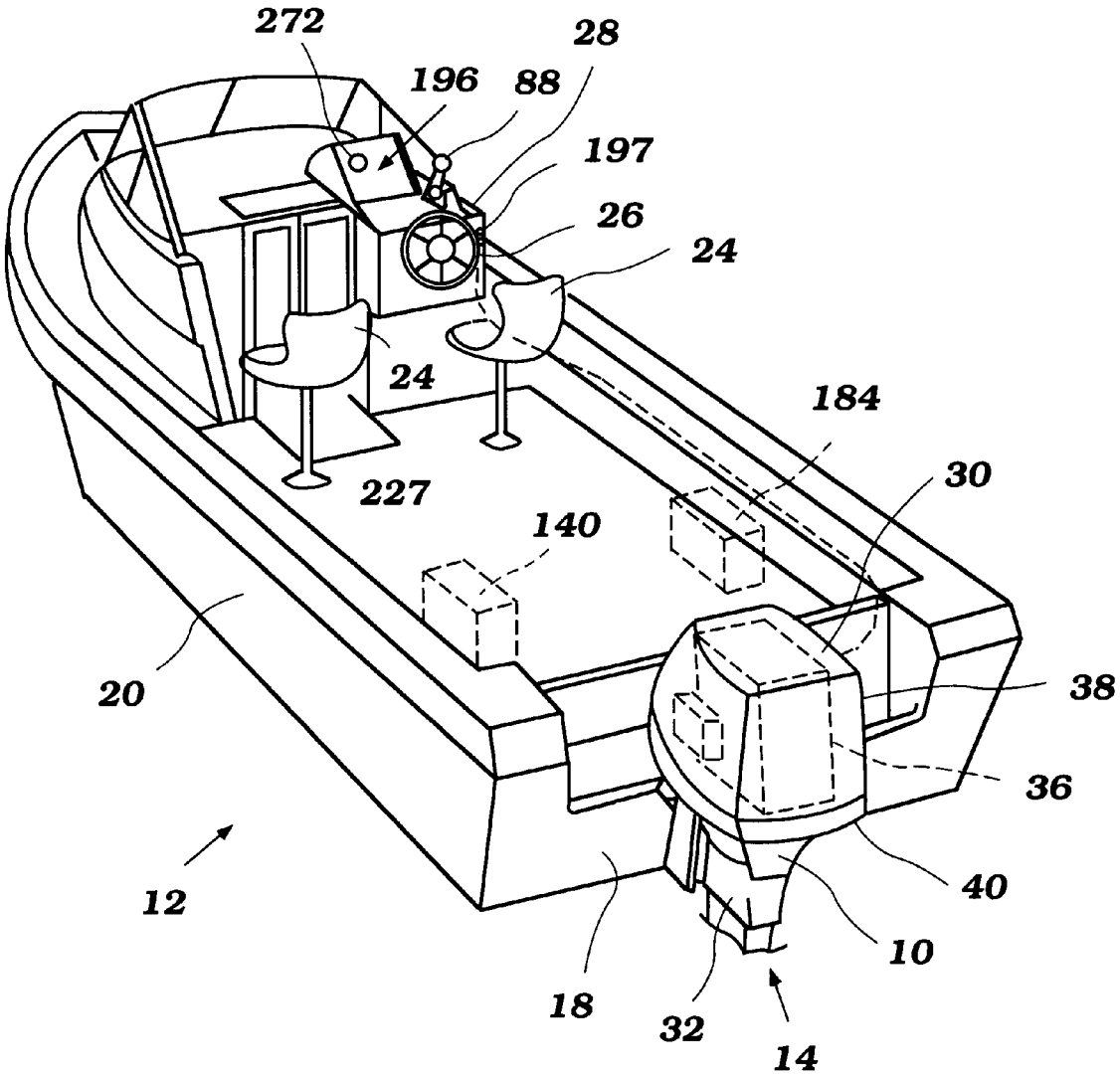
FIG. 1 is a perspective view showing a watercraft propelled by an outboard motor constructed in accord a preferred embodiment of the present invention.

With initial reference to FIG. 1, an outboard motor 10 for powering a watercraft 12 is illustrated. The outboard motor 10 advantageously has a lubrication alarm system arranged and configured in accordance with certain features, aspects, and advantages of the present invention. The outboard motor 10 provides an exemplary environment in which the control system has particular utility. The lubrication alarm system of the present invention may also find utility in applications having engines that experience rapid fluctuations in lubrication system pressures and reservoirs that may experience significant sloshing or reorientation, such as, for example but without limitation, personal watercraft, small jet boats, offroad vehicles, circle track racing vehicles, and heavy construction equipment.

Figure 2:
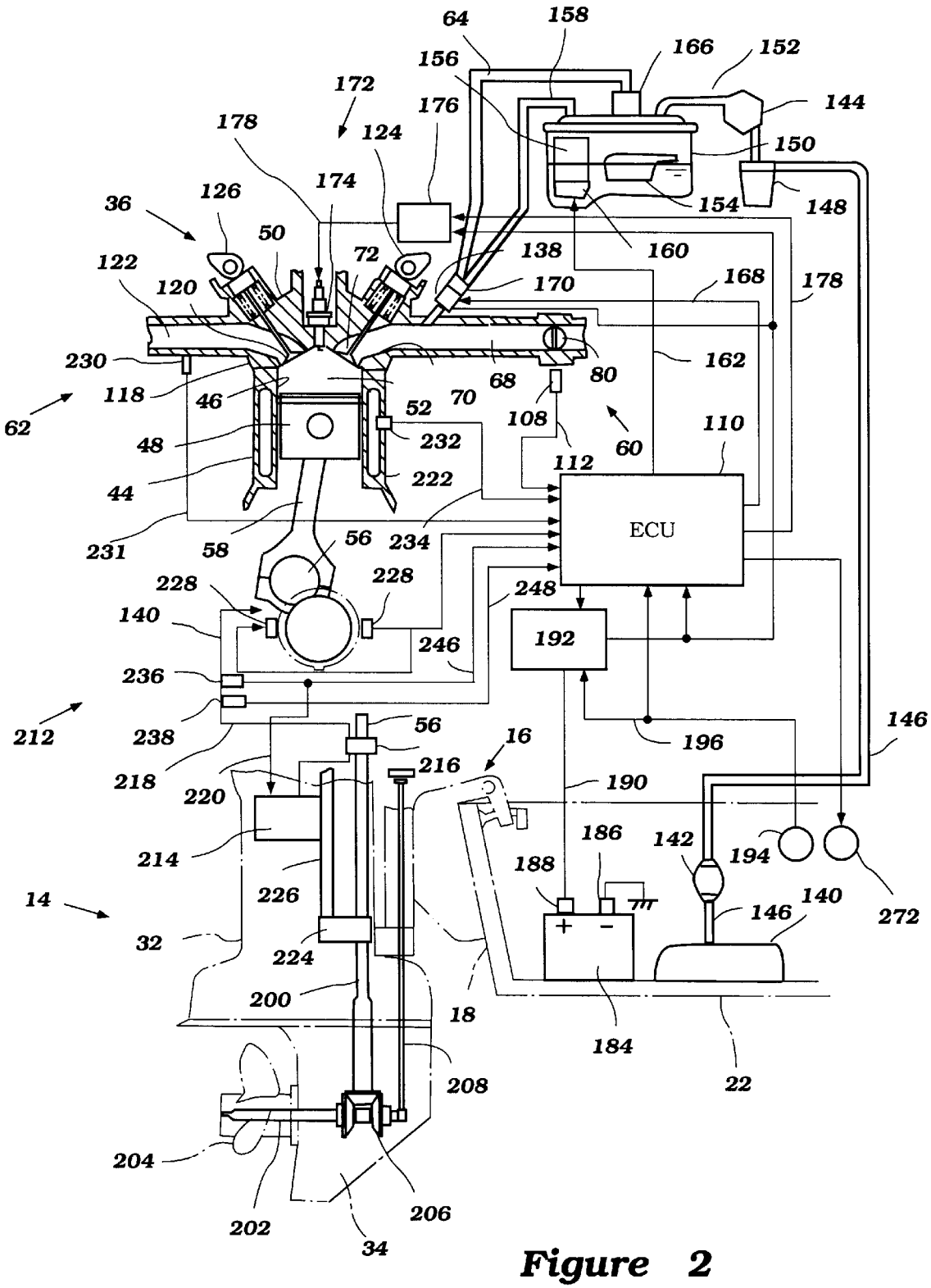
FIG. 2 is a schematic view showing the outboard motor including an engine. The engine, in part, and an ECU are shown generally in the upper half of the figure. The outboard motor, in part, and the watercraft are shown in the lower half of the figure. The ECU, a power supply system, fuel injection system and lubrication system link the two views together. The outboard motor and associated watercraft are illustrated in phantom.

With reference to FIG. 2, in the illustrated embodiment, the outboard motor 10 comprises a drive unit 14 and a bracket assembly 16. Although schematically shown in FIGS. 1 and 2, the bracket assembly 16 comprises a swivel bracket and a clamping bracket. The swivel bracket supports the drive unit 14 for pivotal movement about a generally vertically extending steering axis. The clamping bracket, in turn, is affixed to a transom 18 of the watercraft 12 and supports the swivel bracket for pivotal movement about a generally horizontally extending axis. A hydraulic tilt system can be provided between the swivel bracket and clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front" and "fore" mean at or to the side of the bracket assembly 16, and the terms "rear," "reverse" and "rearwardly" mean at or to the opposite side of the front side, unless indicated otherwise.

As seen in FIG. 1, the associated watercraft 12 is a power boat. The watercraft 12 has a hull 20 that defines a deck 22. A pair of seats 24 are disposed in the forward most area of the deck 22. One of the seats 24 is provided for the operator and is positioned near a steering wheel 26 that is rotatably mounted on a control mast 28. The steering wheel 26 is coupled to the bracket assembly 16 of the outboard motor 10 so that the operator can remotely steer the motor 10 to the left and right.

Figure 3:
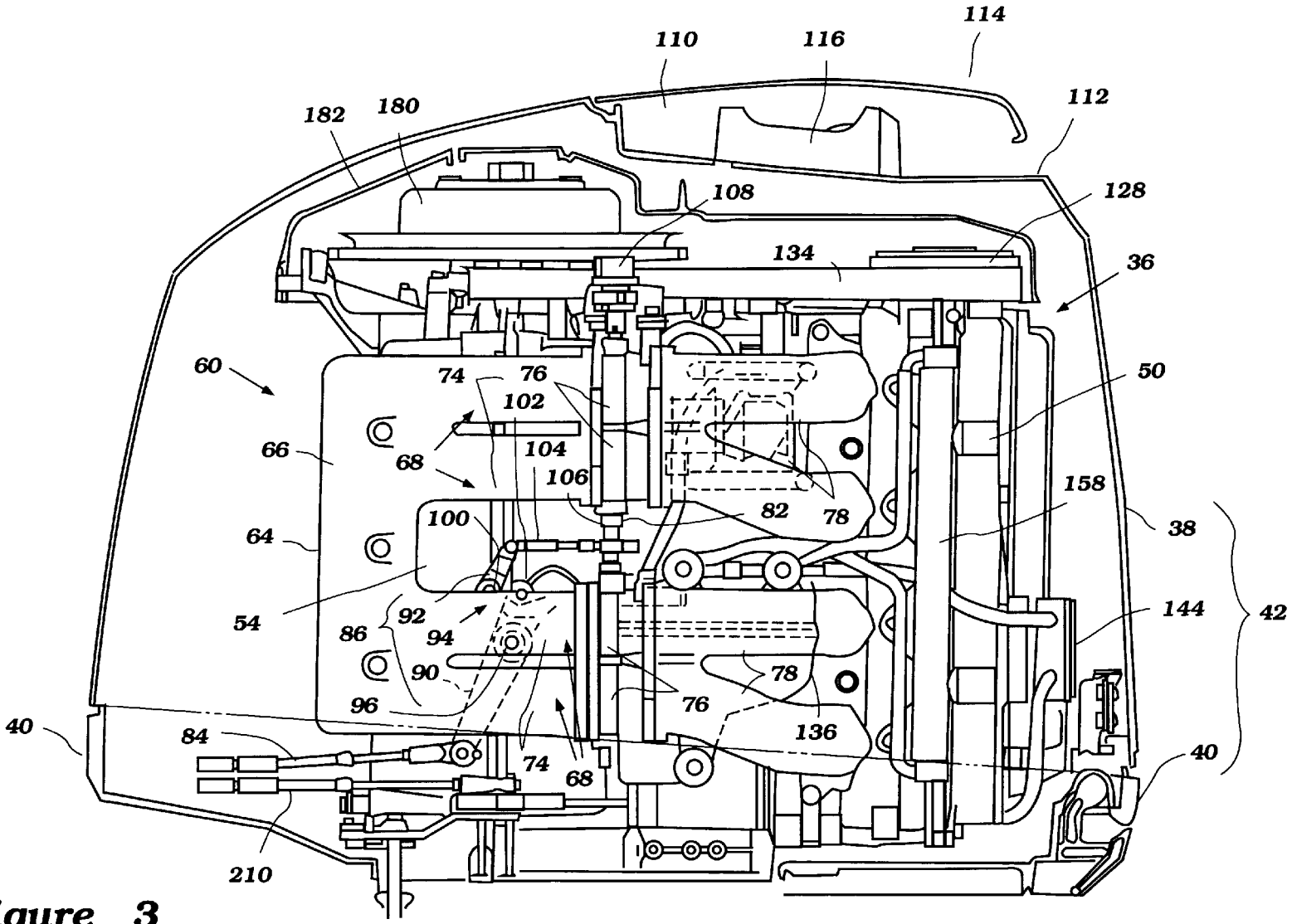
FIG. 3 is an elevational side view of the powerhead of the outboard motor shown in FIG. 2. An upper and lower protective cowling are shown in section.

With reference to FIGS. 1–3, the drive unit 14 will now be described in detail. The drive unit 14 includes a drive shaft housing 32, and a lower unit 34. The power head 30 is disposed atop the drive unit 14 and includes an engine 36, a top protective cowling 38 and a bottom protecting cowling 40. The cowlings 38, 40, define a cowling assembly 42.

The engine 36 operates on a four stroke combustion principle and powers a propulsion device. As seen in FIG. 2, the engine 36 has a cylinder block 44. In the illustrated embodiment, the cylinder block 44 defines four cylinder bores 46 which are generally horizontally extending and spaced generally vertically from each other. As such, the engine 36 is an L4 (in-line 4 cylinder) type. A piston 48 reciprocates in each cylinder bore 46. It is to be noted that the engine may be of any type (v-type, w-type), may have other numbers of cylinders and/or may operate under other principles of operation (two-cycle, rotary, or diesel principles).

A cylinder head assembly 50 is affixed to one end of the cylinder block 44 and defines four combustion chambers 52 with the pistons 48 and the cylinder bores 46. The other end of the cylinder block 44 is closed with a crankcase member 54 (FIG. 3) defining a crankcase chamber.

With reference to FIG. 2, a crankshaft 56 extends generally vertically through the crankcase chamber. The crankshaft 56 is connected to the pistons 48 by connecting rods 58 and rotates with the reciprocal movement of the pistons 48 within the cylinder bores 46. The crankcase member 54 is located at the forward most position of the power head 30, and the cylinder block 44 and the cylinder head assembly 50 extend rearwardly from the crankcase member 54.

The engine 36 includes an air induction system 60 and an exhaust system 62. The air induction system 60 is configured to supply air charges to the combustion chambers 52. The induction system 60 includes a plenum chamber member 64 which defines a plenum chamber 66 therein. Four main intake passages 68 extend from the plenum chamber 66 to a corresponding number of intake ports 70 formed on the cylinder head assembly 50.

The intake ports 70 are opened and closed by intake valves 72. When the intake ports 70 are opened, air from the intake passages 68 and intake ports 70 flows into the combustion chambers 52.

The plenum chamber member 64 is positioned on the port side of the crankcase member 54. The plenum chamber member 64 has an inlet opening (not shown) that opens to the interior of the cowling assembly 42 at its front side. The plenum chamber member 64 functions as an intake silencer and/or a collector of air charges. The air intake passages 68 extend rearwardly from the plenum chamber 66 along the cylinder block 44 and curve toward the intake ports 70. The respective intake passages 68 are vertically spaced apart from each other.

With reference to FIG. 3, the air intake passages 68 are defined by duct sections 74, throttle bodies 76, and runners 78. The duct sections 74 are formed integrally with the plenum chamber member 64.

As shown in FIG. 3, the upper two throttle bodies 76 are integrated with each other. The upper two intake runners 78 are also integrated with each other at their fore portions and then forked into two portions. The lower two throttle bodies 76, as viewed in FIG. 3, and the corresponding lower two intake runners 78 have the same construction as the upper two throttle bodies 76 and intake runners 78, respectively.

The respective throttle bodies 76 support throttle valves 80 (FIG. 2) therein for pivotal movement about axes 81

(FIG. 4) of valve shafts extending generally vertically. The valve shafts are linked together to form a single valve shaft assembly 82 that passes through the throttle bodies 76.

The throttle valves 80 are operable via a throttle cable 84 (FIG. 3) and a non-linear control mechanism 86. The throttle cable 84 is connected to a throttle/shift lever 88 (FIG. 1) that is positioned aside of the control mast 28, so as to be operable by an operator of the watercraft 12.

With reference to FIG. 3, the non-linear control mechanism 86 includes a first lever 90 and a second lever 92 joined together with each other by a cam connection 94. The first lever 90 is pivotally connected to the throttle cable 84 and also to a first pin 96 which is affixed to the crankcase member 54. The first lever 90 has a cam hole 98 at the opposite end of the connection with the throttle cable 84. The second lever 92 is generally shaped as the letter "L" and pivotally connected to a second pin 100 which is affixed to the crankcase member 54. The second lever 92 has a pin 102 that reciprocates within the cam hole 98. The other end of the second lever 92 is connected to a control rod 104. The control rod 104, in turn, is pivotally connected to a lever member which is connected to the throttle valve shaft assembly 82 via a torsion spring 106 that urges the control rod 104 to the position shown in FIG. 3. At this position of the control rod 104, the throttle valve 80 is in a closed position wherein almost no air charge can pass through the air intake passages 68.

When the throttle cable 86 is operated by the throttle/shift lever 88, the first lever 90 pivots about the first pin 96 in a counter-clockwise direction, as viewed in FIG. 3. The second lever 92, then pivots about the second pin 100 in a clockwise direction. Since the cam follower pin 102 of the second lever 92 reciprocates in the cam hole 98, the second lever 92 moves according to the shape of the cam hole 98. Thus, the second lever 92 pushes the control rod 104 against the bias force of the torsion spring 106 to open the throttle valves 80. When the throttle cable 84 is released, the control rod 104 returns to the initial position by the biasing force of the spring 106 and the throttle valves 80 are closed again.

A throttle valve position sensor 108 is arranged atop of a throttle valve shaft assembly 82. A signal from the position sensor 108 is sent to an ECU 110 via a throttle position data line 112 for use in controlling various aspects of engine operation including, for example, but without limitation, fuel injection control which will be described later. The signal from the throttle valve position sensor 108 corresponds to the engine load in one aspect as well as the throttle opening. The ECU 110 is mounted on the left side of the engine 36 and also will be described in detail later.

The air induction system 60 further includes a bypass passage or idle air supply passage that bypasses the throttle valves 80, although it is omitted in FIG. 3. The engine 36 also preferably includes an idle air adjusting unit (not shown) which is controlled by the ECU 110.

With reference to FIG. 3, the cowling assembly 42 generally completely encloses the engine 36. The upper cowling 38 is detachably affixed to the bottom cowling 40 so that an operator can access the engine 36 for maintenance or other purposes. The upper cowling 38 has an air intake compartment 110 defined between a top surface 112 of the upper cowling 38 and cover members 114. Each air intake compartment 110 has an air inlet duct 116 that connects the space in the compartment 110 and the interior of the cowling assembly 42.

In operation, air is introduced into the air intake compartments 110 and enters the interior of the cowling assembly 42 through the air inlet ducts 116. The air then passes through the inlet opening of the plenum chamber member 64 and enters the plenum chamber 66. During idle of the engine 36, an air charge amount is controlled by the throttle valves 80 to meet the requirements of the engine 36. The air charge then flows through the runners 78 and to the intake ports 72 (FIG. 2).

As described above, the intake valves 72 are provided at the intake ports 70. When the intake valves 72 are opened, the air is supplied to the combustion chambers 52 as an air charge. Under the idle running condition, the throttle valves 80 are generally closed. The air, therefore, enters the ports 70 through the idle air adjusting unit (not shown) which is controlled by the ECU 110. The idle air charge adjusted in the adjusting unit is then supplied to the combustion chambers 52 via the intake ports 70.

The exhaust system 62 is configured to discharge burnt charges or exhaust gasses outside of the outboard motor 10 from the combustion chambers 52. Exhaust ports 118 are defined in the cylinder head assembly 50 and are opened and closed by exhaust valves 120. When the exhaust ports 118 are opened, the combustion chambers 52 communicate with a single or multiple exhaust passages 122 which lead the exhaust gasses downstream through the exhaust system 62.

An intake camshaft 124 and an exhaust camshaft 126 are provided to control the opening and closing of the induction valve 72 and exhaust valves 120, respectively. The camshafts 124, 126 extend approximately vertically and parallel with each other. The camshafts 124, 126 have cam lobes that act against the valve 72, 120, at predetermined timings to open and close the respective ports. The cam shafts 124, 126 are journaled on the cylinder head assembly 50 and are driven by the crankshaft 56 via a camshaft drive unit. In the illustrated embodiment, the camshaft drive unit is positioned at the upper end of the engine 36, as viewed in FIG. 3.

Figure 4:
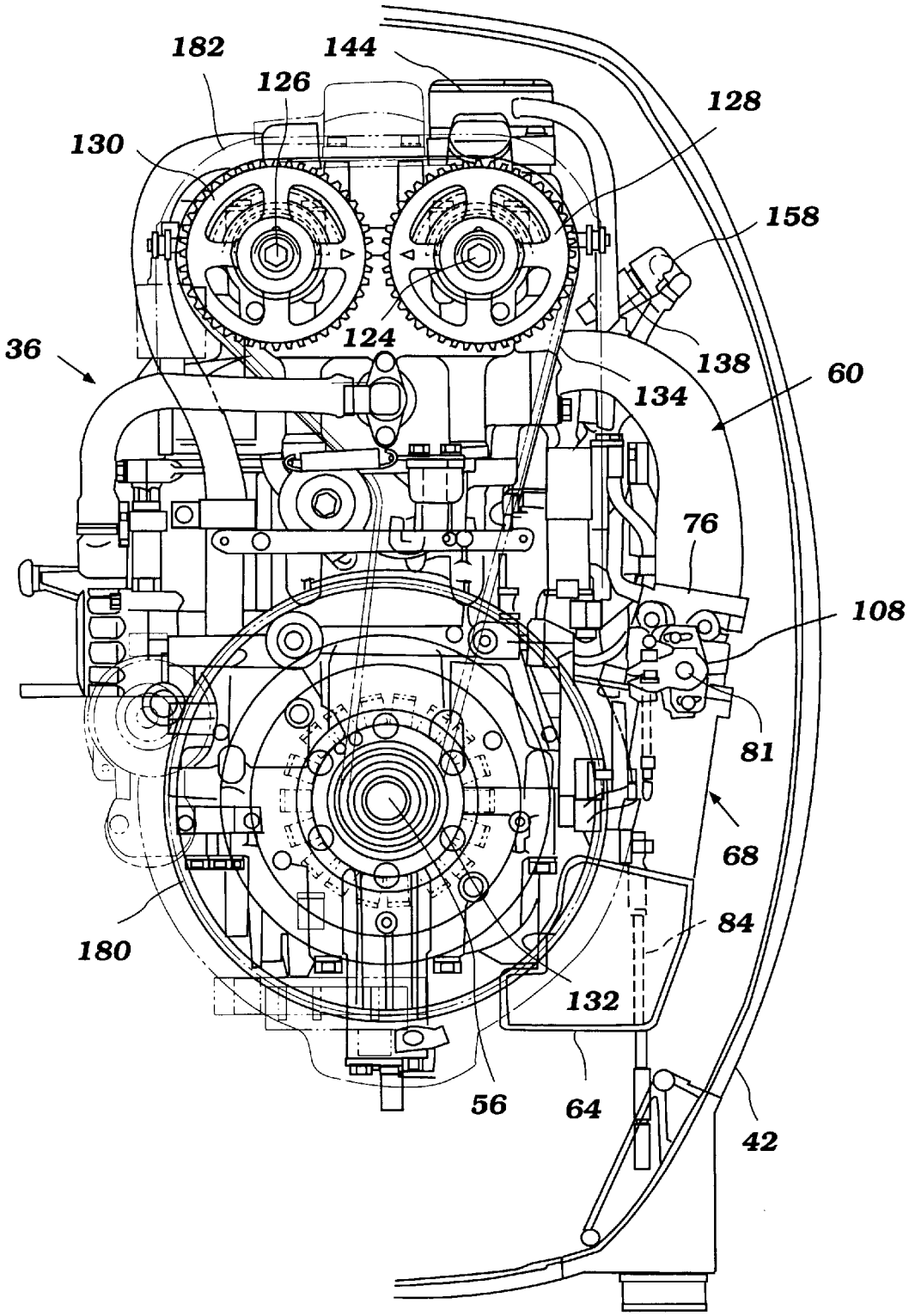
FIG. 4 is a top plan view of the engine shown in FIG. 3. The upper protective cowling is detached one half of the lower cowling is omitted.

With reference to FIG. 4, the camshaft drive unit includes sprockets 128, 130 mounted to an upper end of the camshafts 124, 126. The crankshaft 56 also includes a sprocket 132 at an upper end thereof. A timing belt or chain 134 is wound around the sprockets 128, 130, 132. As the crankshaft 156 rotates, the cam shafts 124, 126 are thereby driven.

With reference to FIG. 2, the engine 36 also includes a fuel injection system 136. The fuel injection system 136 includes four fuel injectors 138 which have injection nozzles exposed to the intake ports 70 so that injected fuel is directed toward the combustion chambers 52. A main fuel supply tank 140 is part of the fuel injection system and is placed in the hull 20 of the associated watercraft 12. Although any place on the deck 22 is available, in the illustrated embodiment, the fuel tank 140 is positioned at a rear left side of the deck 22.

Fuel is drawn from the fuel tank 149 by a first low pressure pump 142 and a second low pressure pump 144 through a first fuel supply conduit 146. The first low pressure pump 142 is a manually-operated pump. The second low pressure pump 144 is a diaphragm-type pump operated by one of the intake and exhaust camshafts 124, 126. In the illustrated embodiment, the second low-pressure fuel pump 144 is mounted on the cylinder head assembly 50 (FIG. 3).

A quick disconnect coupling (not shown) is preferably provided in the first fuel conduit 146. A fuel filter 148 is positioned in the conduit 146 at an appropriate location.

From the low pressure pump 144, fuel is supplied to a vapor separator 150 through a second fuel supply conduit 152. In the illustrated embodiment, the vapor separator 150 is affixed to the lower two intake runners 78, as viewed in FIG. 3 and between the intake runner 78 and the cylinder block 44. At the vapor separator end of the conduit 152, a float valve is provided which is operated by a float 154 so as to maintain a uniform level of the fuel contained in the vapor separator 136.

A high pressure fuel pump 156 is provided within the vapor separator 136 and pressurizes fuel within the vapor separator 150. The high-pressure fuel pump 156 is connected with the fuel injectors 138 through a fuel delivery conduit 158. Preferably, the conduit 158 itself forms a fuel rail connecting the fuel injectors 158 with the high-pressure fuel pump 156. The high-pressure fuel pump 156 is driven by an electric motor 160 that is directly connected to the pump 156 at its lower end, as viewed in FIG. 2. The electric motor 160 is activated by the ECU 110 and is controlled via a fuel pump control line 162.

A fuel return conduit 164 is also provided between the fuel injectors 138 and the vapor separator 150. Excess fuel that is not injected by the injector 138 returns to the vapor separator 150 through the conduit 164. A pressure regulator 166 is mounted on the vapor separator 150 at the end of the return conduit 164 to limit the pressure of the fuel delivered to the fuel injectors 138. The flow generated by the return of unused fuel from the fuel injectors aids in cooling the fuel injectors.

In operation, a predetermined amount of fuel is sprayed into the intake ports 70 via the injection nozzles of the fuel injectors 138. The timing and duration of the fuel injection is dictated by the ECU 110. The fuel charge delivered by the fuel injectors 138 then enters the combustion chambers 52 with an air charge at the moment the intake valves 72 are opened. Since the fuel pressure is regulated by the pressure regulator 166, a duration during which the nozzles of the injectors 138 are opened is a factor determined by the ECU 110 to measure an amount of fuel to be injected by the fuel injectors 138. The duration and the injection timing are thus controlled by the ECU 110 through a fuel injector control line 168. Preferably, the fuel injectors 138 are operated by solenoids 170, as is known in the art. Thus, the fuel injector control line 168 signals the solenoids 170 to open according to the timing and duration determined by the ECU 110.

The engine 36 further includes an ignition system, indicated generally by the reference numeral 172. Four spark plugs 174 are fixed on the cylinder head assembly 50 and exposed into the respective combustion chambers 52. The spark plugs 174 ignite an air/fuel charge at a certain timing as determined by the ECU 110 to burn the air/fuel charge therein. For this purpose, the ignition system 172 includes an ignition coil 176 interposed between the spark plugs 174 and the ECU 110, along a spark plug control line 178.

As seen in FIGS. 3 and 4, a flywheel assembly 180 is affixed to an upper end of the crankshaft 56. A cover member 182 covers the flywheel assembly 180, sprockets 128, 130, 132, and the belt 134 so as to prevent debris and/or other foreign materials from becoming entrained in the sprockets 128, 130, 132 and to protect an operator from the moving components when the upper cowling 38 is removed. The flywheel assembly 180 includes an AC generator that generates electric power. The generated AC power is led to a battery 184 (FIG. 2), through a rectifier that rectifies the AC power to DC power. The battery 184 accumulates electrical energy therein and also supplies it to electrical equipment including the ECU 110, solenoids 170, and ignition coil 176.

A negative pole 186 of the battery 184 is grounded, while the positive pole 188 is coupled to the ECU 110, the solenoids 170, and the ignition coil 176 through a power supply line 190. A main relay 192 is provided between the power supply line 190 and the ECU 110. A main switch 194 is provided to activate the main relay 192 and the ECU 110. Preferably, the main switch 194 is placed on the control mast 28 at the right-hand side of the steering wheel 26 (FIG. 1) so as to be easily accessible by an operator.

While not illustrated, the engine 36 also can include a recoil starter to drive the flywheel assembly 180 when starting the engine 36. A starter motor can be employed in addition or in the alternative to the recoil starter for the same purpose. The use of a starter motor is preferred when the present invention is employed with larger size engines. The recoil starter is operated by an operator of the watercraft 12 when the operator wants to start the engine 36. For example, the starter motor may be activated when the main switch 194 is actuated by the operator of the watercraft 12.

With reference to FIG. 1, the battery 184 is located in the hull 20 of the associated watercraft 12. Like the fuel tank 140, the battery 184 may be placed at any position on the deck 22, however, in the illustrated embodiment, it is positioned at the rear right side of the deck 22. Desirably, a display panel 196 is provided forwarded from the steering wheel 26 facing the chair 24 provided behind the steering wheel 26. Various instruments may be provided in the display panel 196 to provide the operator with various information regarding engine operation, including, for example but without limitation, engine speed, fuel level, lubricant pressure, engine temperature, and watercraft speed.

As seen in the lower half of FIG. 2, the driveshaft housing 32 depends from the power head 30 and supports a driveshaft 200 which is driven by the crankshaft 56 of the engine 36. The driveshaft 200 extends generally vertically through the driveshaft housing 32. The driveshaft housing 32 also defines internal passages which form portions of the exhaust system 62.

The lower unit 34 depends from the driveshaft housing 32 and supports a propeller shaft 202 which is driven by the driveshaft 200. The propeller shaft 202 extends generally horizontally through the lower unit 34. In the illustrated embodiment, the propulsion device includes a propeller 204 that is affixed to an outer end of the propeller shaft 202 and is thereby driven.

A transmission 206 is provided between the driveshaft 200 and the propeller shaft 202. The transmission 206 couples together the two shafts 200, 202 which lie generally normal to each other (i.e., at a 90° angle) with bevel gear combination.

A switchover mechanism is provided for the transmission 206 to shift rotational directions of the propeller 204 between forward, neutral and reverse. The switchover mechanism includes a shift cam (not shown), a shift rod 208 and shift cable 210 (FIG. 3). The shift rod 208 extends generally vertically through the driveshaft housing 32 and the lower unit 34, while the shift cable 210 extends outwardly from the lower cowling 40 and is connected to the throttle/shift lever 88 that is operable by the operator when the operator wants to shift the transmission directions.

The lower unit 34 also defines an internal passage that forms a discharge section of the exhaust system 62. At engine speed above idle, the majority of the exhaust gasses are discharged to the body of water surrounding the outboard motor 10 through the internal passage and finally through a hub of the propeller 204.

Figure 5:
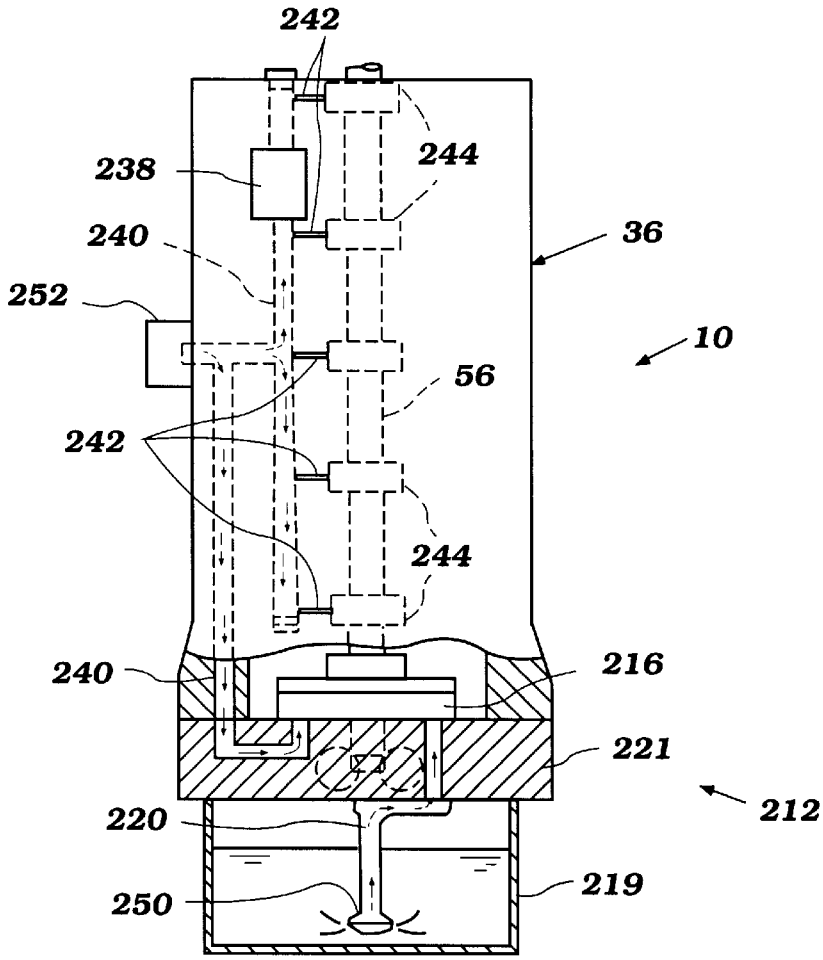
FIG. 5 is a partial sectional view of the engine shown in FIG. 3 illustrating an interior of a crankcase and an lubricant pan of the engine.

The engine 36 also has a lubrication system 212, which is schematically represented in FIGS. 2 and 5. The lubrication system 212 is provided for lubricating certain portions of the engine 36, such as, for example but without limitation, the pivotal joints of the connecting rod 58 with the crankshaft 56 and with the piston 48, the cam shaft 124, 126, the bearings journaling the crankshaft 56 within the crankcase and the walls of the cylinder bores 46.

A lubricant reservoir 214 is disposed at an appropriate location in the driveshaft housing 32. Lubricant in the reservoir 214 is drawn therefrom by an lubricant pump 216. In the illustrated embodiment, the lubricant pump 216 is driven by the crankshaft 56. However, the lubricant pump 216 may alternatively be driven by the crank shaft 200 or an electric motor (not shown). Lubricant from the lubricant pump 216 is directed to a lubricant supply line 218 and is delivered to various portions of the engine which benefit from circulating lubricant. After the lubricant has passed through the various engine galleries, the lubricant collects in an lubricant pan 219 (FIG. 5) provided at a lower end of the crank case. Lubricant returns to the lubricant pump 216 via a return line 220. Thus, the lubrication system 212 is formed as a closed loop. As shown in FIG. 5, an exhaust guide 221 is provided at the lower end of the engine 36, between the pan 219 and the lubricant pump 216. The operation and control of the lubrication system 212 will be described in more detail below.

The outboard motor 10 also includes a cooling system for cooling heated portions in the engine 36 such as the cylinder block 24 and a cylinder head assembly 55. In the illustrated embodiment, a water jacket 222 is provided in the cylinder block 44. A water pump 224 is provided for supplying cooling water to the various water jackets which may be included in the engine 36, including the water jacket 222. The water pump 224 is driven by the driveshaft 200. Although not shown, a water inlet is provided in the lower unit 34 to draw cooling water from the body of water surrounding the motor 36. The water is supplied to the water jackets through a water supply conduit 226.

As noted above, the ECU 110 controls engine operations including fuel injection from the fuel injectors 138 and firing of the spark plugs 174, according to various control maps stored in the ECU 110. In order to determine appropriate control scenarios, the ECU utilizes maps and/or indices stored within the ECU 110 with reference to data collected from various sensors. For example, the ECU 110 may refer to data collected from the throttle valve position sensor 108 and other sensors provided for sensing engine running conditions, ambient conditions or conditions of the outboard motor 10 that will affect engine performance.

In the illustrated embodiment, there is provided, associated with the crankshaft 56, plural crankshaft angle position sensors 228 which, when measuring crankshaft angle versus time, output a crankshaft rotational speed signal or engine speed signal to the ECU 110. The crankshaft position sensors 228 define a pulse generator that produces pulses which are, in turn, converted to an engine speed within the ECU 110 or another separate converter (not shown).

A combustion condition or oxygen ($O_2$) sensor 230 senses the in-cylinder combustion conditions by sensing the residual amount of oxygen in the combustion products at a point in time approximately when the exhaust port is opened. The output from the oxygen sensor 230 is output to the ECU 110 via an oxygen sensor data line 231.

A water temperature sensor 232 is connected to the cylinder block 44 so as to communicate with the water jacket 222. The water temperature sensor 232 is configured to sense the temperature of water flowing through the water jacket 222 and to output a water temperature signal to the ECU 110 via a water temperature data line 234.

A lubricant temperature sensor 236 and a lubricant pressure sensor 238 are connected to the engine at positions appropriate for sensing lubricant temperature and pressure, respectively. For example, with reference to FIG. 5, the lubricant sensor pressure 238 may be positioned so as to communicate with an lubricant gallery 240 which includes a number of branch passages 242 which distribute lubricant flowing therethrough to a plurality of bearings 244 which support and journal the crankshaft 256. A lubricant temperature data line 246 and a lubricant pressure data line 248 connect the ECU 110 with the lubricant temperature sensor 236 and the lubricant pressure sensor 238, respectively.

The above noted sensors correspond to merely some of those conditions which may be sensed for purposes of engine control and it is, of course, practicable to provide other sensors such as an intake air pressure sensor, intake air temperature sensor, an engine height sensor, a trim angle sensor, a knock sensor, a neutral sensor, a watercraft pitch sensor, a shift position sensor and an atmospheric temperature sensor in accordance with various control strategies.

With reference to FIGS. 2 and 5, the lubricant system 212 will be described in more detail. As noted above, the lubricant supply system 212 generally comprises a lubricant pump 214 and a plurality of lubricant passages, conduits and galleries through which lubricant is supplied to various moving components of the engine 36. The system 212 also includes the lubricant pan 218, or a return reservoir, such that lubricant may drain from the moving components of the engine 36 and into the pan 218. While the illustrated embodiment features a lubricant pan 218, it is anticipated that the present invention may be used with engines featuring a dry-sump arrangement as well as the illustrated wet-sump arrangement.

In the illustrated embodiment, lubricant is drawn from within the lubricant pan 218 through a pick-up 250. As is known in the art, the pick-up 250 may be provided with a mesh straining cover to remove some of the larger impurities prior to being cycled through the lubrication system 212.

Preferably, the lubricant is then pumped by the lubricant pump 214 through a high-pressure pressure regulator, or a pressure regulating valve (not shown). The lubricant is then delivered to the various engine components, including, for example, the bearings 244 in any suitable manner. At an uppermost portion of the lubricant passages in the illustrated embodiment, the lubricant pumped by the pump 214 communicates with the pressure sensor 238, as illustrated in FIG. 5. The pressure sensor 238 is preferably configured to generate an output signal which is proportional to the lubricant pressure sensed by the sensor 238, e.g., as the pressure sensed increases, an output voltage of the sensor 238 also increase proportionately. More preferably, the sensor 238 is configured to generate a signal that has a linear relationship with the lubricant pressure sensed.

The lubricant is preferably supplied to the camshafts 124, 126 and allowed to return to the lubricant pan 218 via return passages 220. The sensor 238 also may be positioned in any of a number of other locations along the lubricant passages.

As shown in FIG. 5, in the illustrated embodiment, lubricant from the lubricant pump 216 is directed through the supply passage 240 to an lubricant filter 252. The lubricant filter removes impurities from the lubricant formed therein and returns lubricant to the lubricant gallery 240 for distribution to the various engine components.

Figure 7:
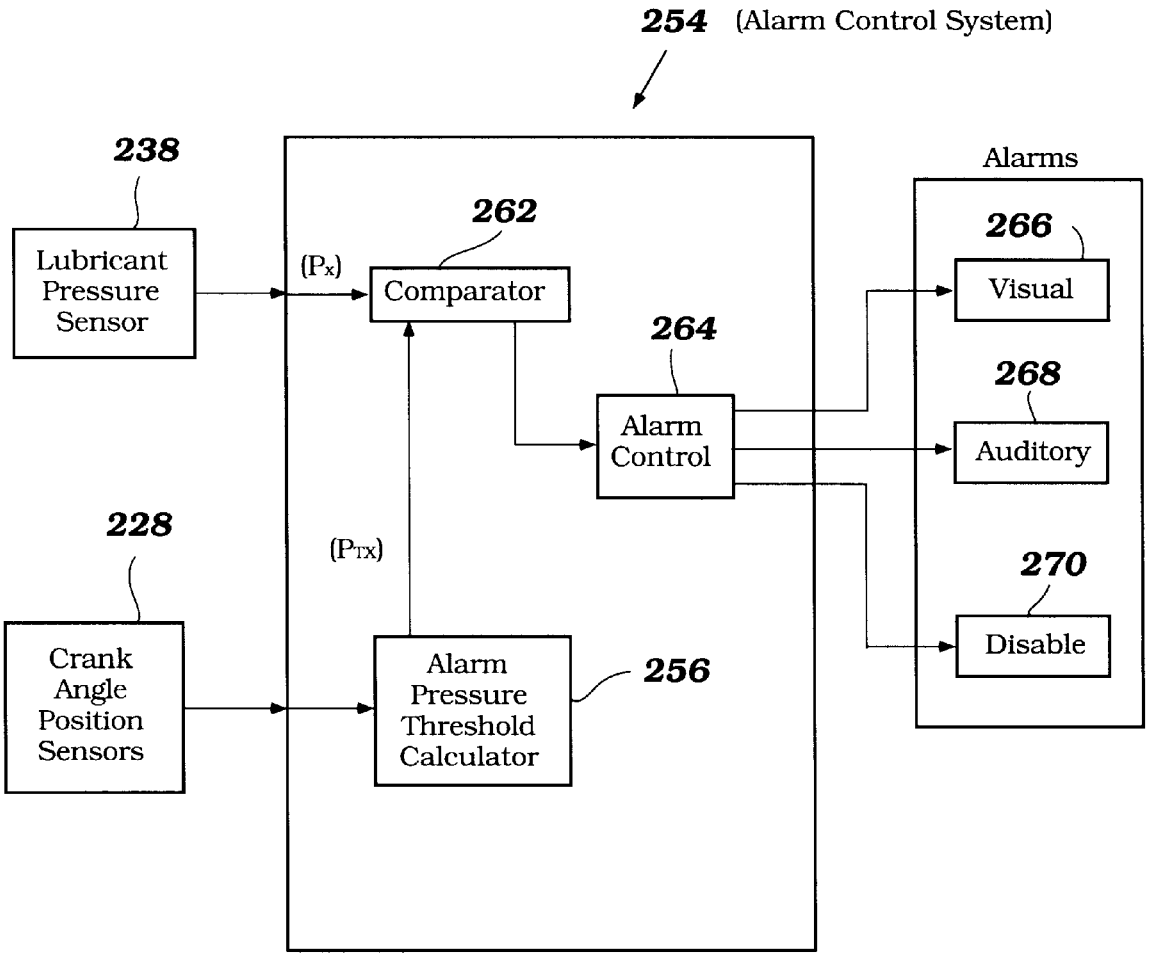

With reference to FIG. 7, the outboard motor 10 of the present embodiment features an alarm control system 254.

The alarm control system 254 samples signals provided by a variety of sensors adapted to convey information about the engine's operational condition. In the illustrated embodiment of FIG. 7, the alarm control system 254 samples signals provided by the lubricant pressure sensor 238 and the crank angle position sensors 228.

The alarm control system 254 also includes an alarm pressure threshold calculator 256 which is configured to calculate an alarm pressure threshold. The calculator 256 is preferably configured to generate a pressure threshold $P_{TX}$ which corresponds to a lubricant pressure which is greater than a minimum lubricant pressure required to protect the engine 36 at the engine speed detected by the crank angle position sensors 228.

As shown in FIG. 7, the alarm pressure threshold calculator 256 receives engine speed data from the crank angle position sensors 228. The data received from the crank angle position sensors 228 may be in the form of a voltage received directly from the crank angle position sensors 228, may be converted to an engine speed by the alarm pressure threshold calculator 156 of the ECU 110, or may be in the form of a digital signal produced by a converter (not shown) which is indicative of a rotational speed of the crankshaft 56.

Figure 6:
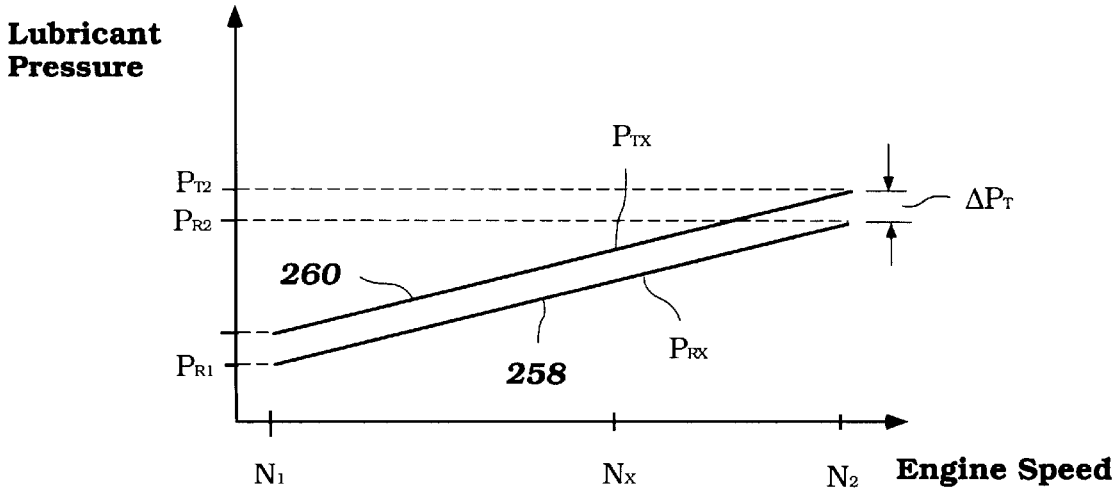
FIG. 6 is a graph illustrating a relationship between engine speed and lubricant pressure in the FIG. 7 is a schematic representation of a lubrication alarm unit constructed in accordance with embodiment of the present invention.

Preferably, the alarm pressure threshold calculator 256 determines the alarm pressure threshold by comparing the engine speed with a control map stored in the lubricant alarm system 254. For example, FIG. 6 illustrates a map of alarm threshold pressures as a function of engine speed. The vertical axis of the graph of FIG. 6 indicates lubricant pressure and the horizontal axis indicates engine speed. Line 258 of FIG. 6 indicates a minimum lubricant pressure required to protect the engine 36 over the engine speed range $N_1$ to $N_2$. The minimum required pressure at engine speed $N_1$ is a lubricant pressure of $P_{R1}$. The minimum required lubricant pressure at engine speed $N_2$ is $P_{R2}$. Also shown in FIG. 6 is a line 260 which represents an alarm pressure threshold $P_{TX}$ which is greater than the minimum lubricant pressure required for a particular engine speed. For example, the alarm threshold pressure $P_{T1}$ s greater than the minimum required lubricant pressure $P_{R1}$. Similarly, the alarm pressure threshold $P_{T2}$ at engine $N_2$ is greater than the minimum required lubricant pressure $P_{R2}$.

As shown in FIG. 6, the vertical difference between the minimum required pressure line 258 and the alarm pressure threshold line 260 remains constant along the length of the lines 258, 260 by a distance of $\Delta P_T$. However, it is to be noted that the minimum required pressure line 258 may be represented as a curve according to the lubrication requirements of a particular engine. Additionally, the alarm pressure threshold line 260 may be represented as a curve having a nonuniform offset $\Delta P_T$ from the minimum required lubricant pressure line 258. However, regardless of the shape of the alarm pressure threshold line 260, it is advantageous for the alarm pressure threshold $P_{TX}$ to be greater than the minimum required lubricant pressure $P_{RX}$ for any given engine speed.

As shown in FIG. 7, the alarm control 254 includes a comparator 256. The comparator is connected to the alarm pressure threshold calculator 256 and the lubricant pressure sensor 238. The comparator is configured to compare output from the alarm pressure threshold calculator 256 and the lubricant pressure sensor 238 so as to determine if the lubricant pressure $P_X$ in the engine 36 is less than the alarm pressure threshold $P_{TX}$ determined by the alarm pressure threshold calculator 256. The comparator 262 is also connected to an alarm control 264 which may be connected to a visual alarm 266, an auditory alarm 268 and/or a disable unit 270.

The alarm control 264 may be configured to control the alarms 266, 268, 270 individually or sequentially. For example, the alarm control 264 may be configured to initiate an alarm by first initializing the visual alarm 256. The visual alarm 256 may comprise a warning indicator such as an alarm lamp 272 (FIG. 1) mounted in the display panel 196. Optionally, the alarm control 264 may then initiate the auditory alarm 268 which may comprise an audible tone emitted from a noise generator such as a buzzer (not shown) mounted in the vicinity of the operator's seat 24 (FIG. 1). Further, the alarm control 264 may initialize the disable unit 270 which may be configured to partially or completely disable the engine 36 by causing at least one of the ignition system, the fuel system, or the power system of the engine 36 to partially or completely cease ignition of fual/air charges in the combustion chambers 52.

In operation, the alarm system 254 receives an engine speed signal from at least one of the crank angle position sensors 228 as indicated in FIG. 7. The alarm pressure threshold calculator 256 then calculates an alarm pressure threshold $P_{TX}$ based on the speed signal from the crank angle position sensor 228 and based on a control map, such as the map shown in FIG. 6.

The comparator 266 receives the alarm pressure threshold $P_{TX}$ from the alarm pressure threshold calculator 256 as well as a lubricant pressure signal $P_X$ from the lubricant pressures sensor 238. The comparator 262 compares the alarm pressure threshold signal $P_{TX}$ to the lubricant pressure signal $P_X$ and determines whether the lubricant pressure $P_X$ in the engine 36 with the alarm pressure threshold signal $P_{TX}$. If the lubricant pressure $P_X$ is less than the alarm pressure threshold $P_{TX}$, the comparator 262 signals the alarm control 264 to initiate an alarm sequence. As noted above, the alarm control 264 may control the alarms 266, 268, 270, individually or sequentially.

Optionally, the alarm control system 254 may be configured to detect an undesirable fluctuation of lubricant pressure in the lubrication system 212. For example, with reference to FIG. 9, a lubricant pressure fluctuation in the engine 36 is illustrated therein. The graph of FIG. 9 includes a vertical axis indicating lubricant pressure in the engine 36 and the horizontal axis indicates time.

Figure 9:
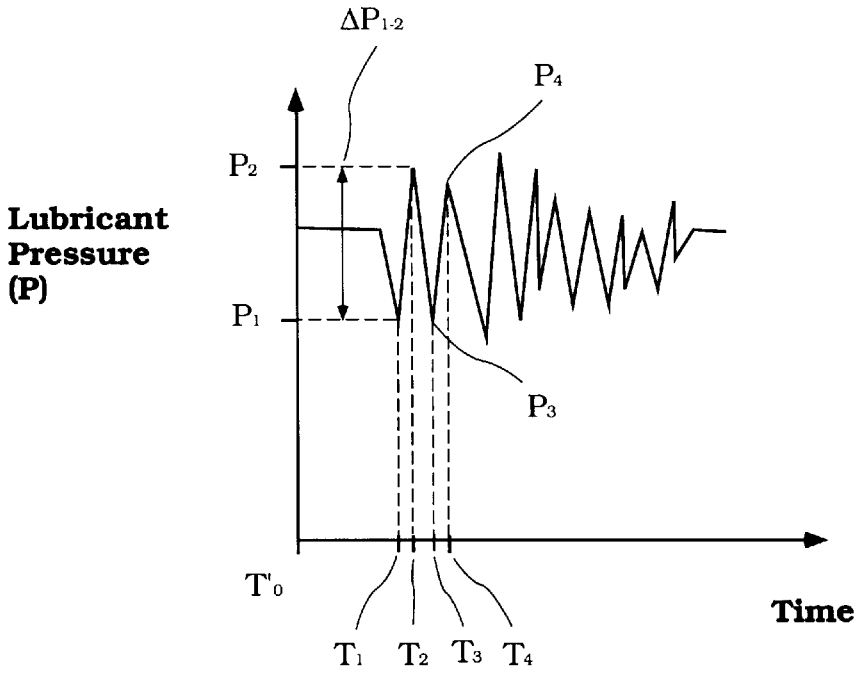
FIG. 9 is a graph illustrating lubricant pressure over time during a state of operation of an engine.

During operation of the engine 36, lubricant pressure $P_X$ within the engine 36 may fluctuate as a result of the operating conditions. However, certain malfunctions within the engine 36 may cause the lubricant pressure 36 to fluctuate to an undesirable degree. For example, during operation of a watercraft such as the watercraft 12 with the outboard motor 10 attached thereto lubricant within the lubricant pan 218 (FIG. 5) may be splashed within the lubricant pan 218 thereby cause the lubricant to move in and out of contact with the collector 250. When the collector 250 is not in contact with liquid lubricant, air enters the supply line 218 to the lubricant pump 216 which interrupts a flow of lubricant through the lubrication system. As air bubbles travel through the various engine galleries and conduits within the engine 36, the lubricant pressure within the engine 36 will fluctuate. For example, as shown in FIG. 9, as air bubbles pass by the lubricant pressure sensor 238, the lubricant pressure $P_X$ sensed by the lubricant pressure sensor 238 will fluctuate rapidly over time. Additionally, as the air travels through the lubrication system, various components of the engine 36 may be inadequately lubricated. Thus, the alarm control system 254 is desirably configured to detect undesirable fluctuations in the lubricant pressure $P_X$ which may be indicative of inadequate lubrication within the engine 36.

As shown in FIG. 9, the fluctuation in lubricant pressure $P_X$ within the engine 36 is sensed by lubricant pressure sensor 238 over time. For example, at time $T_1$ the lubricant pressure sensor 238 detects a lubricant pressure $P_1$ in the engine 36. Subsequently, the lubricant pressure sensor 238 senses lubricant pressure $P_2$ at time $T_2$, pressure $P_3$ at time $T_3$, and lubricant pressure $P_4$ at time $T_4$. Each fluctuation $\Delta P_F$ is defined as the absolute value of the difference from a current lubricant pressure $P_X$ to a previous detected lubricant pressure $P_{(X-1)}$. For example, a pressure fluctuation $\Delta P_F$ from time $T_1$ to time $T_2$ would be the absolute value of the difference of $P_2$ and $P_1$, i.e., $$|P_2-P_1|=\Delta P_F$$

It is to be noted that during normal operation of the outboard motor 10, there will be acceptable fluctuations in lubricant pressure. However, it is preferable that the alarm control system 254 is configured to detect and respond to pressure fluctuations above the predetermined pressure fluctuation alarm threshold $\Delta P_A$.

Thus, the predetermined pressure fluctuation alarm threshold $\Delta P_A$ is set at a pressure difference which would be indicative of inadequate lubricant flow in the engine 36, such as for example but without limitation, pressure fluctuations caused by air flowing through the lubrication system 212 in the engine 36. Thus, if a pressure fluctuation occurs in the lubrication system 212, the alarm control system 254 may initiate an alarm, or may record the fluctuation for further computations.

For example, the comparator 262, or another separate comparator (not shown) may be configured to compare a present lubricant pressure $P_X$ with a previous lubricant pressure $P_{(X-1)}$. The comparator 262 may calculate the absolute value of the difference between lubricant pressure $P_X$ and lubricant pressure $P_{(X-1)}$. For example, the comparator 262, with reference to FIG. 9, may calculate the absolute value of the difference between lubricant pressure $P_1$ and lubricant pressure $P_2$ as pressure fluctuation $\Delta P_{1-2}$. If the pressure fluctuation $\Delta P_{1-2}$ is greater than a predetermined pressure alarm threshold $\Delta P_A$, the comparator 262 records data indicating a pressure fluctuation greater than the predetermined pressure fluctuation threshold $\Delta P_A$ has been exceeded at a time corresponding to the fluctuation, i.e., $\Delta P_{1-2}$.

Preferably, the comparator 262, or another component (not shown) of the alarm control system 254 tallies the number of pressure fluctuations which exceed the predetermined pressure fluctuation alarm threshold $\Delta P_A$ over a period of time and records the number of such fluctuations as $F_P$.

Preferably, the comparator, or another component of the alarm control system 254, compares the number of unacceptable pressure fluctuations $F_P$ with the predetermined pressure fluctuation rate threshold $F_{PT}$. The predetermined pressure fluctuation rate threshold $F_{PT}$ indicates the maximum number of unacceptable pressure fluctuations that may occur for a predetermined period of time. For example, the pressure fluctuation threshold may be set at a rate such as two per second, for example. Thus, if the alarm control system 254 detects more than two unacceptable pressure fluctuations in one second, the alarm control system 254 emits an alarm.

For example, if the comparator 262 detects three unacceptable pressure fluctuations in one second, i.e., $F_P=3$, where the predetermined pressure fluctuation rate threshold $F_{PT}=2$, the comparator 262 will signal the alarm control 264 to emit an alarm. As noted above, the alarm control 264 may operate the alarms 266, 268, 270 individually or sequentially.

The comparator 262 and the alarm pressure threshold calculator 256 may be a comparator, a calculator, a logic circuit board or the like. The illustrated embodiment features visual alarms, auditory alarms, and disabling arrangements. Of course, tactile alarms and other alarms suitable to transmit information regarding an undesirable characteristic of engine performance may be used. Visual alarms may include, without limitation, lights and gauges. Auditory alarms may include, without limitation, buzzers, bells, sirens, and the like. Disabling arrangements may, as will be recognized, selectively disable combustion within selected combustion chambers in order to slow engine speed or completely stop engine operation in any suitable manner.

Figure 8:
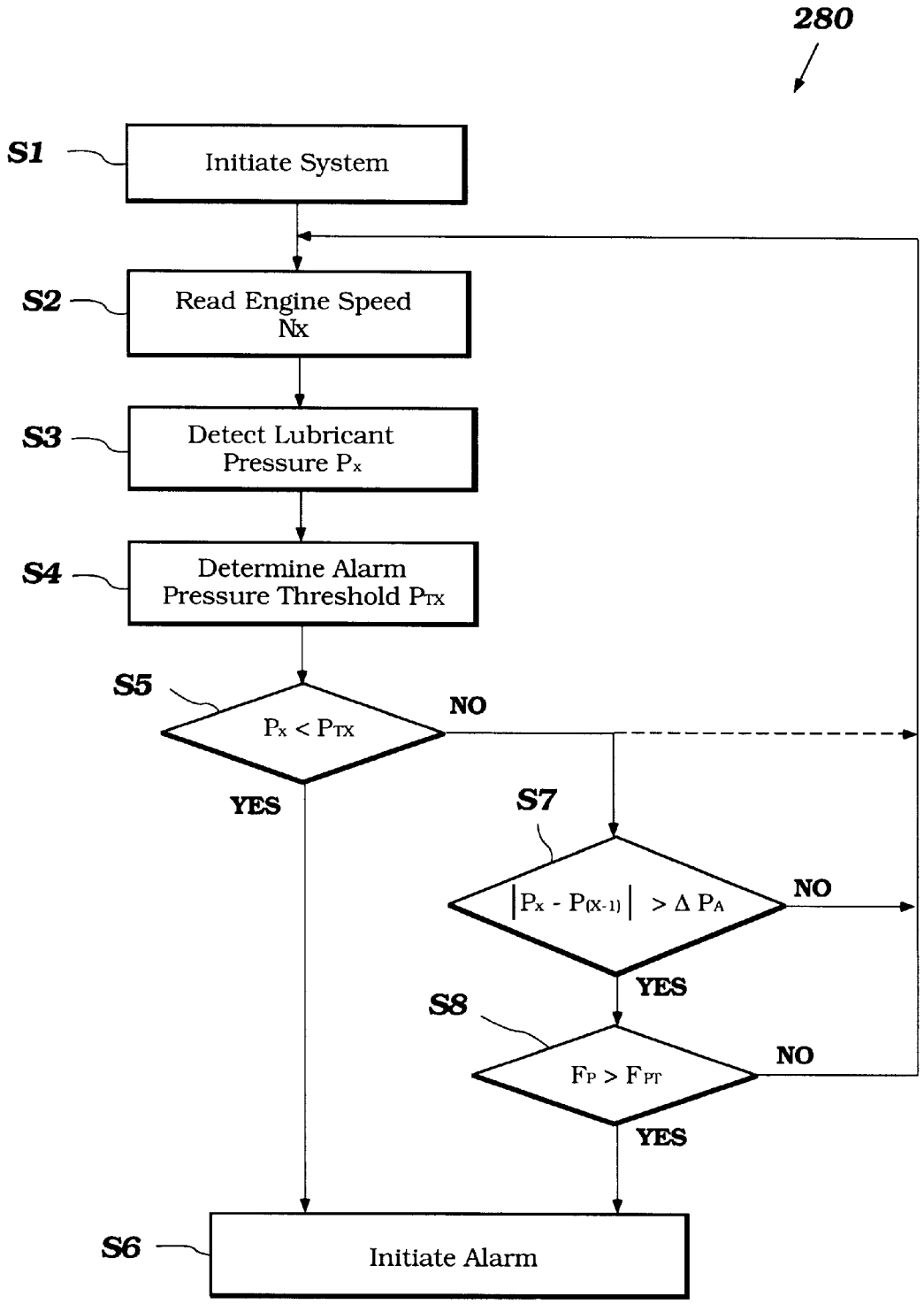
FIG. 8 is a flow diagram of a lubrication system control routine.

FIG. 8 illustrates a control subroutine 280 for practicing the present alarm scheme for the engine 36. The control routine 280 is initiated when the engine 36 is running. As shown in FIG. 8, the control routine 280 may start at a step S1 where it is determined whether the engine is running. If the engine is running, the program moves on to a step S2. Alternatively, the control subroutine 280 may operate at all times when the engine 36 is running At the step S2, the alarm system 254 reads the engine speed. For example, the alarm system 254, may receive a signal from the crank angle position sensors 228, or from a translator which translates the signal from the crank angle position sensors 228 into another signal for further processing by the alarm system 254. After the alarm system 254 has read the engine speed, $N_X$, the control subroutine 280 moves on to a step S3.

At the step S3, the control subroutine 280 detects the lubricant pressure $P_X$ in the engine 36. After the lubricant pressure $P_X$ has been detected, the control subroutine 280 moves on to a step S4.

At the step S4, the control subroutine 280 calculates an alarm pressure threshold $P_{TX}$ based on the engine speed $N_X$, as described above with respect to the alarm control system 254. After the alarm pressure threshold $P_{TX}$ has been determined, the control subroutine 280 moves on to a Step S5.

At the step S5, it is determined whether the lubricant pressure $P_X$ is less than the alarm pressure threshold $P_{TX}$. Alternatively, the control subroutine 280 may determine whether the lubricant pressure $P_X$ is less than or equal to the alarm pressure threshold $P_{TX}$, as is apparent to one of ordinary skill in the art. If the lubricant pressure $P_X$ is less than the alarm pressure threshold $P_{TX}$, the control subroutine 280 moves on to a step S6.

At the step S6, the control subroutine initiates an alarm. As noted above, the alarm system 254 may include at least one of a visual alarm 266, an auditory alarm 268, and a disable unit 270. Additionally, the control routine 280 may operate the alarms 266, 268, 270 individually or sequentially.

If, however, at the step S5, it is determined that the lubricant pressure $P_X$ is equal to or greater than the alarm pressure threshold $P_{TX}$, the control subroutine may return to step S2 and repeat. Alternatively, if it is determined at the step S5, that the lubricant pressure $P_X$ is greater than the alarm pressure threshold $P_{TX}$, the control subroutine may move on to a step S7.

At the step S7, it is determined whether fluctuation of the current engine lubricant pressure $P_X$ has changed from the previously read engine lubricant pressure $P_{(X-1)}$ more than a predetermined amount $\Delta P_A$. Preferably, the predetermined pressure change $\Delta P_A$ is set at a pressure change which would be indicative of a lubricant system malfunction, as described above with respect to the alarm control system 254. Thus, if it is determined that the change in lubricant pressure, e.g., the absolute value of $P_X - P_{(X-1)}$ is greater than $\Delta P_A$, the control routine 280 moves on to a step S8.

At the step S8, it is determined whether the engine lubricant pressure has fluctuated more than a predetermined number of times over a predetermined time period. If it is determined, at the step S8 that the number of lubricant pressure fluctuations $F_P$ above the predetermined pressure differential $\Delta P_A$ is greater than the predetermined lubricant pressure fluctuation threshold $F_{PT}$, the control routine 280 moves on to step S6 and initiates at least one of alarms 266, 268, 270, as noted above.

If, however, it is determined at the steps S7 or S8 that the requirements stated therein are not satisfied, the control routine 280 returns to step S2 and repeats.

It is to be noted that the alarm control system 254 may be in the form of a hard wired feedback control circuit, as schematically represented in FIG. 7. Alternatively, the alarm control system 254 may be constructed of a dedicated processor and a memory for storing a computer program configured to perform the steps S1–S8. Additionally, the alarm control system 254 may be constructed of a general purpose computer having a general purpose processor and the memory for storing the computer program for performing the routine 280. Preferably, however, the alarm control system 254 is incorporated into the ECU 110, in any of the above-mentioned forms.

By constructing the alarm control system 254 as such, the present invention provides for enhanced prevention of engine damage caused by insufficient lubricant flow. For example, with reference to FIG. 10, lubricant pressure fluctuations during an engine speed fluctuation scenario is shown therein. The graph in FIG. 10 includes lubricant pressure plotted on the left-hand side vertical axis and is plotted as a solid line on the graph. The right-hand side vertical axis of the graph indicates engine speed plotted as a broken line. The horizontal axis of FIG. 10 indicates elapsed time.

Figure 10:
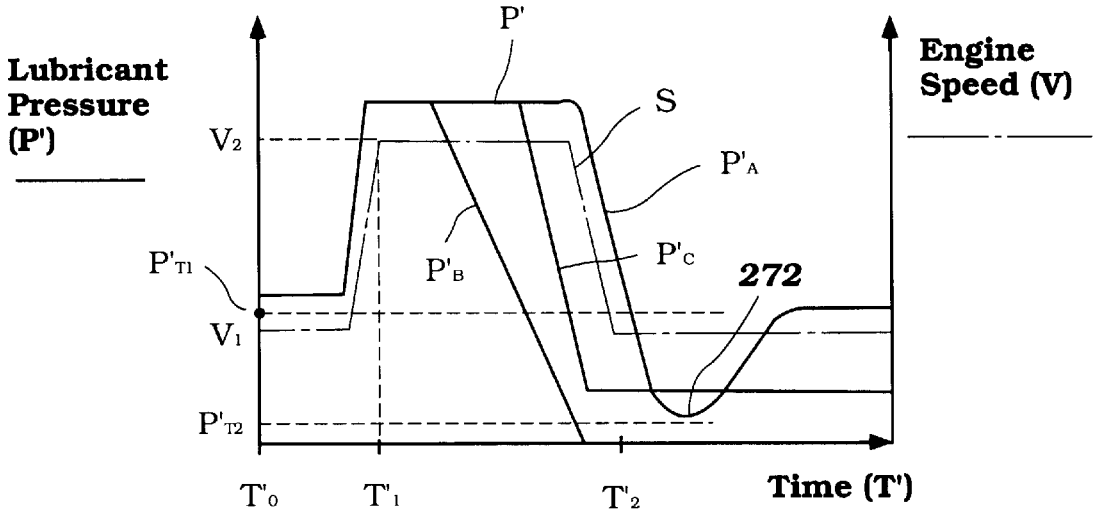
Figure 10 Background Art
FIG. 10 is a graph illustrating lubricant pressure over time at particular engine speeds of conventional outboard motors.

The graph of FIG. 10 illustrates an example of engine speed fluctuation of a conventional outboard motor. The engine speed of the outboard motor 10 starts at $V_1$ at time $T_0'$, increases to engine speed $S_2$ at time $T_1'$, and returns to speed $S_1$ at time $T_2'$. When the lubrication system of a conventional outboard motor is operating properly, the lubricant pressure P' increases and decreases proportionally with engine speed V. However, due to the viscous nature of lubricant, the pressure of lubricant does not vary as rapidly as engine speed. For example, as shown in FIG. 10, the curve labeled as $P'_A$ indicates the lubricant pressure within an outboard motor which is operating properly. Thus, as shown in FIG. 10, lubricant pressure $P'_A$ increases as the engine speed increases from engine speed $S_1$ to $S_2$ and decreases again as the engine speed drops from engine speed $S_2$ to engine speed $S_1$. However, due to the nature of lubricants such as oil, the lubricant pressure $P'_A$ drops to a minimum point 272 before rising again to a proper lubricant pressure appropriate for the engine speed $S_1$.

In certain conventional outboard motors, lubricant pressure alarms have been calibrated to emit an alarm if the lubricant pressure drops below a pressure $P'_{T1}$. However, since under normal operation, lubricant pressure within an outboard motor may drop below this threshold down to a minimum point 272 during normal operation, such conventional outboard motors may erroneously emit an alarm when no malfunction is actually present. Thus, other conventional outboard motors have been known to include alarms which are calibrated to emit an alarm only when the lubricant pressure within the engine drops below a pressure $P'_{T2}$ which is lower than $P'_{T1}$, thus avoiding the emission of an alarm when the lubricant pressure in the outboard motor drops to a minimum point, such as minimum point 272.

However, one aspect of the present invention involves a realization that lubrication system alarms which only operate so as to emit an alarm when the lubricant pressure within the engine drops below a single predetermined threshold suffer from the drawback that other unacceptable pressure fluctuations may not trigger the lubricant pressure alarm. For example, FIG. 10 illustrates an lubricant pressure drop along line $P'_B$ where the lubricant pressure in an engine drops rapidly from a normal lubricant pressure along line $P'_A$ to zero. In this case, an alarm would be sounded in an outboard motor which uses a predetermined alarm threshold pressure $P'_{T1}$ or $P'_{T2}$. However, the alarm would not be emitted until lubricant pressure P' drops below the corresponding thresholds. Thus, for the time period while the lubricant pressure is dropping along line $P'_B$, the engine will be inadequately lubricated and suffer damage. Additionally, if the lubrication system of the engine experiences a partial lubricant pressure reduction such as illustrated by the line $P'_C$, the lubricant pressure alarm may not be triggered at all.

For example, with a lubricant pressure alarm set at the threshold $P'_{T2}$, a pressure drop along the line $P'_C$ would not trigger the corresponding alarm. Finally, if a lubricant pressure within an outboard motor fluctuates similarly to the fluctuation illustrated in FIG. 9, without extending below the pressure thresholds $P'_{T1}$ or $P'_{T2}$ illustrated in FIG. 10, those corresponding alarms would not be triggered, despite the inadequate flow of lubricant through the engine.

Thus, by constructing the lubricant pressure alarm control system 254 in accordance with the present invention, undesirable reductions in lubricant pressure within the engine 36 are more accurately identified and an operator is informed more readily regarding undesirable lubricant pressures within the engine, thus enhancing the durability and lifespan of the engine 36.

Of course, the foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. An engine for a water vehicle comprising, a lubricant pump configured to pump lubricant through at least one lubricant supply passage, a lubricant pressure sensor positioned along the supply passage, the pressure sensor configured to emit a signal indicative of a lubricant pressure in the supply passage, an engine speed sensor configured to emit a signal indicative of a speed of the engine, an alarm unit communicating with the lubricant pressure sensor and the engine speed sensor, the alarm unit being configured to determine an alarm threshold pressure as a function of engine speed, the alarm unit being configured to emit an alarm when the lubricant pressure sensor senses a lubricant pressure below the alarm threshold pressure and when the lubricant pressure sensor senses a rate of fluctuation in the lubricant pressure that is larger than a predetermined pressure fluctuation rate threshold.

2. The engine of claim 1, wherein the lubricant pressure sensor is configured to output a pressure signal that is proportional to the lubricant pressure in the supply passage.

3. The engine of claim 2, wherein the lubricant pressure sensor is configured to output a pressure signal that is a linear function of the lubricant pressure in the supply passage.

4. The engine of claim 1, wherein the alarm unit is configured such that the alarm threshold pressure determined is greater than a minimum lubricant pressure required for proper lubrication of the engine at the engine speed sensed by the engine speed sensor.

5. The engine of claim 1, wherein the alarm emitted by the alarm unit is at least one of a visual alarm, an audible alarm, and disabling the engine.

6. The engine of claim 5, wherein the alarm unit is configured to continue to emit the alarm until the lubricant pressure sensed by the pressure sensor rises above the alarm threshold pressure.

7. The engine of claim 1, wherein the alarm unit is configured to emit an alarm if the lubricant pressure sensed by the pressure sensor fluctuates over a pressure differential that is larger than a predetermined pressure differential.

8. A lubricant pressure alarm system for use with a lubrication system of an engine of a water vehicle, the alarm system comprising a lubricant pressure sensor configured to detect a lubricant pressure in the lubrication system and to output a signal indicative of the lubricant pressure in the lubrication system, an engine speed sensor, an alarm pressure threshold calculator communicating with the engine speed sensor and configured to determine an alarm pressure threshold as a function of engine speed, the alarm system being configured to emit an alarm if the lubricant pressure sensed by the lubricant pressure sensor fluctuates over a pressure differential that is larger than a predetermined pressure differential.

9. The alarm system of claim 8, wherein the lubricant pressure sensor is configured to output a pressure signal that is proportional to the lubricant pressure in the lubrication system.

10. The alarm system of claim 9, wherein the lubricant pressure sensor is configured to output a pressure signal that is a linear function of the lubricant pressure in the lubrication system.

11. The alarm system of claim 8, wherein the alarm pressure threshold calculator is configured such that the alarm pressure threshold determined is greater than a minimum lubricant pressure required for proper lubrication of the engine at the engine speed sensed by the engine speed sensor.

12. The alarm system of claim 8, wherein the alarm emitted by the alarm system is at least one of a lamp, an audible alarm, and disabling the engine.

13. The alarm system of claim 12, wherein the alarm is configured to continue until the lubricant pressure sensed by the pressure sensor rises above the alarm threshold pressure.

14. The alarm system of claim 8, wherein the alarm system is configured to emit an alarm if the lubricant pressure sensed by the pressure sensor fluctuates at a rate that is larger than a predetermined alarm fluctuation threshold rate.

15. A lubricant pressure alarm system for use with a lubrication system of an engine of an a water vehicle, the alarm system comprising a lubricant pressure sensor configured to detect a lubricant pressure in the lubrication system and to output a signal indicative of the lubricant pressure in the lubrication system, the alarm system being configured to sense a fluctuation in the lubricant pressure and to emit an alarm if the lubricant pressure fluctuates at a rate larger than a predetermined lubricant pressure fluctuation rate threshold.

16. The alarm system of claim 15, wherein the lubricant pressure sensor is configured to output a pressure signal that is proportional to the lubricant pressure in the lubrication system.

17. The alarm system of claim 16, wherein the lubricant pressure sensor is configured to output a pressure signal that is a linear function of the lubricant pressure in the lubrication system.

18. The alarm system of claim 15 additionally comprising an engine speed sensor and an alarm pressure threshold calculator configured to determine an alarm pressure threshold that is a function of an engine speed sensed by the engine speed sensor and that is greater than a minimum lubricant pressure required for proper lubrication of the engine at the engine speed sensed by the engine speed sensor.

19. The alarm system of claim 15, wherein the alarm emitted by the alarm system is at least one of a visual alarm, an audible alarm, and disabling the engine.

20. The alarm system of claim 19, wherein the alarm system is configured to continue to emit the alarm until the lubricant pressure sensed by the lubricant pressure sensor rises above the alarm threshold pressure.

21. The alarm system of claim 15, wherein the alarm system is configured to emit the alarm if the lubricant pressure sensed by the lubricant pressure sensor fluctuates over a pressure differential that is larger than a predetermined pressure differential threshold.

22. A method of monitoring lubricant pressure in an engine having a lubrication system comprising the steps of sensing an engine speed of the engine, sensing a lubricant pressure in the lubrication system, determining an alarm lubricant pressure threshold as a function of engine speed, comparing the lubricant pressure sensed in the lubrication system to the alarm lubricant pressure threshold, emitting an alarm if the lubricant pressure sensed in the lubrication system is below the alarm lubricant pressure threshold, and emitting an alarm if the lubricant pressure fluctuates over a pressure differential that is larger than a predetermined pressure differential.

23. The method of claim 22 additionally comprising generating a signal which is proportional to the lubricant pressure sensed in the lubrication system, wherein the step of comparing comprises comparing a pressure corresponding to the proportional signal with the alarm lubricant pressure threshold.

24. The method of claim 22, wherein the step of emitting an alarm comprises at least one of illuminating a lamp, triggering an audible alarm, and disabling the engine.

25. The method of claim 22, wherein the step of determining an alarm lubricant pressure threshold comprises setting the alarm lubricant pressure threshold greater than a minimum lubricant pressure required for proper lubrication of the engine at the engine speed sensed in the step of sensing the engine speed.

26. The method of claim 22, wherein the step of emitting the alarm comprises emitting the alarm until the lubricant pressure sensed rises above the alarm lubricant pressure threshold.

27. The method of claim 22, additionally comprising the step of emitting an alarm if the lubricant pressure sensed by the lubricant pressure sensor fluctuates at a rate that is larger than a predetermined alarm fluctuation threshold rate.

28. A method of monitoring lubricant pressure in an engine having a lubrication system comprising, determining a rate of fluctuation in a lubricant pressure in the lubrication system, comparing the rate of fluctuation to a predetermined lubricant pressure fluctuation rate threshold, and emitting an alarm if the fluctuation rate is greater than the predetermined lubricant pressure fluctuation rate threshold.

29. The method of claim 28 additionally comprising generating a signal which is proportional to the lubricant pressure sensed in the lubrication system and determining an alarm lubricant pressure threshold, wherein the step of comparing comprises comparing a pressure corresponding to the proportional signal with the alarm lubricant pressure threshold.

30. The method of claim 29 additionally comprising sensing a speed of the engine, wherein the step of determining an alarm lubricant pressure threshold comprises setting the alarm lubricant pressure threshold to a value greater than a minimum lubricant pressure required for proper lubrication of the engine at the engine speed sensed in the step of sensing a speed of the engine.

31. The method of claim 28, wherein the step of emitting an alarm comprises at least one of illuminating a lamp, triggering an audible alarm, and disabling the engine.

32. The method of claim 28, wherein the step of emitting an alarm comprises emitting the alarm until a rate of lubricant fluctuation determined in the step of the determining a rate of fluctuation drops below the predetermined lubricant pressure fluctuation rate threshold.

33. The method of claim 28, additionally comprising the step of emitting an alarm if the lubricant pressure sensed by the lubricant pressure sensor fluctuates over a pressure differential that is larger than a predetermined pressure differential threshold.

* * * * *